US005472757A

United States Patent [19]

Ogawa et al.

[11] Patent Number: 5,472,757

[45] Date of Patent: Dec. 5, 1995

[54] INK JET RECORDING SHEET

[75] Inventors: Susumu Ogawa; Kouji Idei; Hideaki Senoh, all of Tokyo, Japan

[73] Assignee: Mitsubishi Paper Mills Limited, Tokyo, Japan

[21] Appl. No.: 171,463

[22] Filed: Dec. 22, 1993

[30] Foreign Application Priority Data

Dec. 25, 1992 [JP] Japan ..... 4-347030
Jun. 30, 1993 [JP] Japan ..... 5-160979

[51] Int. Cl.[6] ..... B41M 5/00

[52] U.S. Cl. ..... 428/40; 427/152; 428/195; 428/206; 428/211; 428/331; 428/537.1; 428/537.5

[58] Field of Search ..... 427/146, 152; 428/195, 537.5, 211, 40, 331, 507, 206, 537.1

[56] References Cited

U.S. PATENT DOCUMENTS 4,370,370 1/1983 Iwata et al. ..... 428/40
4,619,858 10/1986 Dam et al. ..... 428/211
4,855,277 8/1989 Walter ..... 428/40
4,954,395 9/1990 Hasegawa et al. ..... 428/318.4

FOREIGN PATENT DOCUMENTS 0493100 7/1992 European Pat. Off. .
2485578 12/1981 France .
1-8381 3/1989 Japan .
4-234473 8/1992 Japan .
4-341885 11/1992 Japan .

*Primary Examiner*—Pamela R. Schwartz
*Attorney, Agent, or Firm*—Armstrong, Westerman, Hattori, McLeland & Naughton

[57] ABSTRACT

Disclosed is an ink jet recording sheet which comprises a support mainly composed of wood fibers, an ink-receiving layer provided on one side of the support and a tacky layer provided on another side of the support where a barrier layer comprising a film-forming material is provided between-the support and the ink-receiving layer and/or between the support and the adhesive layer. Spread of ink due to penetration of the adhesive into the ink-receiving layer is prevented and images excellent in sharpness and color quality can be obtained.

8 Claims, 1 Drawing Sheet

INK JET RECORDING SHEET

BACKGROUND OF THE INVENTION

The present invention relates to an ink jet recording sheet, in particular the one usable as pressure-sensitive or quick stick labels, that controls ink dots spread upon being printed by an ink jet printer using an aqueous ink and can develop color images of favorable sharpness and color quality.

The ink jet recording method performs recording of graphics and characters by depositing ink droplets ejected by various working principles on a recording sheet such as paper. Ink jet recording has such favorable features that it makes high-speed recording possible, that it produces little noise, that it can easily perform multi-color recording, that there is no limitation as to the kind of patterns or images, and that it requires no processing for development and fixing. Thus, ink jet recording is rapidly becoming widespread in various fields as devices for recording various characters including kanjis (Chinese characters) and color images. Furthermore, the images formed by the multi-color ink jet recording method are by no means inferior to those printed by a multi-color press or those obtained by color photography. Besides, the use of ink jet recording extends to a field of full-color image recording where number of copies is not so many, since costs per copy are less than those employing the photographic process.

Fields of use of ink jet recording has diversified and one of such fields of note is pressure-sensitive or quick stick labels. The labels such as those for price tags, for optical recognition tags (bar code), and for advertisement (stickers) are being increasingly used. Bar code prints should have a high degree of sharpness and an ink jet printed image can meet this requirement if ink dots spread is controlled. An advantage of the ink jet printed label is that it afford to print color image with a bar code at a corner. A label that prints a color message and a bar code of high sharpness and color quality could have significant promotion effect of a merchandise to which it is put. Another reason to support proliferation of ink jet printed color labels is that a reasonably good image can be drawn and printed by relatively simple devices like a personal computer and printer. Quick stick labels are used widely since they adhere easily to a variety of objects, and their use on an ink jet printer is gradually expanding where merits of both the labels and ink jet printing are combined. However, such favorable combination would not be of significance unless the image printed on the label is as good in image and color reproducibility as the same image printed on a normal ink jet recording sheet.

When an ordinary ink jet recording sheet is processed into a pressure-sensitive label by providing a tacky layer on the back, the ink tends to spread more than needed or even bleed on the surface, so that the record formed lacks the sharpness required for bar code, and the color quality and image reproducibility required for promotion of a merchandise. Improvements have been attempted on coating composition of ink-receiving layer, but any of them has failed so far to show a promise. Accordingly, ink jet recording sheets which inhibit spread of ink dots even when they are processed into pressure-sensitive labels are required. In the current imaging-oriented society, the demand for inhibition of ink dots spread has grown considerably severer.

SUMMARY OF THE INVENTION

The object of the present invention is to provide an ink jet recording sheet that inhibits ink dots spread when it is printed by an ink jet printer using an aqueous ink and can develop an image of good sharpness and color quality and especially that can be suitably processed into quick stick labels.

The inventors have made intensive research on ink jet recording sheets and have found that when a tacky layer is provided on the back of an ink jet recording sheet, dots printed on the ink receiving layer tend to spread or even bleed, and that this is caused by migration of components in the tacky layer composition into the ink-receiving layers through the support. Namely, the thus migrated components block ink reception and fixing capability of the ink-receiving layer. While magnitude of that migration and blocking varies depending on the kind of adhesives used in the tacky layer, said components that migrate are thought to be solvents such as ethyl acetate and toluene, plasticizers of relatively low molecular weight and surfactants.

Therefore, the above-mentioned problems of the ink jet recording sheets can be solved by preventing migration of those components into the ink-receiving layer from the tacky layer.

That is, the present invention relates to an ink jet recording sheet which comprises a support mainly composed of wood fibers, an ink-receiving layer provided on one side of the support and a tacky layer provided on another side of the support, wherein a barrier layer comprising a film-forming material is provided between the support and the ink-receiving layer or between the support and the tacky layer, or barrier layers are provided between the support and the ink-receiving layer and between the support and the tacky layer.

Figure 1:
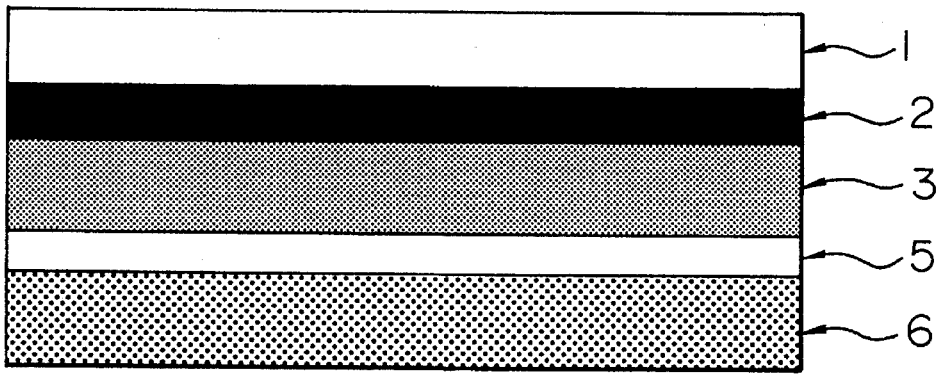
FIG. 1 is a sectional view of an embodiment of the present invention in which a barrier layer is provided between a support and an ink-receiving layer.
Figure 2:
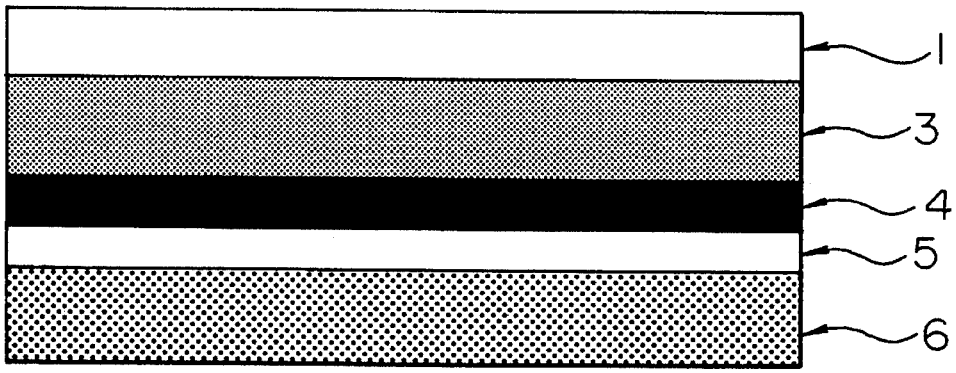
FIG. 2 is a sectional view of an another embodiment of the present invention in which a barrier layer is provided between a support and a tacky layer.
Figure 3:
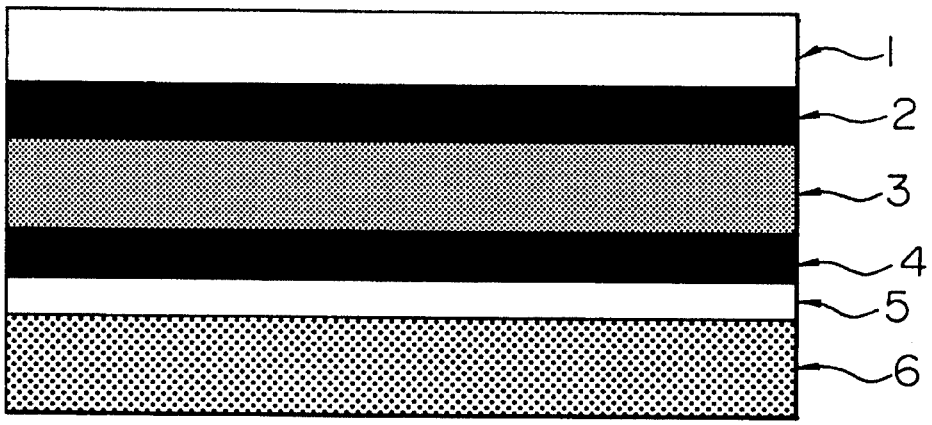
FIG. 3 is a sectional view of a still another embodiment of the present invention in which two barrier layers are provided; one between a support and an ink-receiving layer and another between the support and a tacky layer.

In these FIGS. 1–3, 1 indicates an ink-receiving layer, 2 a barrier layer, 3 a support, 4 a barrier layer, 5 a tacky layer and 6 a release paper.

DETAILED DESCRIPTION OF THE INVENTION

The ink jet recording sheet of the present invention comprises a support provided with an ink-receiving layer on one side and a tacky layer on another side, said tacky layer being covered with a release paper. A barrier layer may provided between the support and the ink-receiving layer as shown in FIG. 1, between the support and the tacky layer as shown in FIG. 2, or two barrier layers may be provided; one between the support and the ink-receiving layer and another between the support and the tacky layer as shown in FIG. 3.

FIGS. 1–3 are schematic drawings for illustration purpose only and by no means specify or limit thickness, basis weight, coating weight and the like of the ink jet recording sheet of the present invention. In addition, the present invention includes variations of those embodiments; for instance, one or more intermediate layers provided between the ink-receiving layer and the barrier layer, between the barrier layer and the support, between the barrier layer and the tacky layer, and between the tacky layer and the release paper.

As the film-forming material for forming said barrier layer, there may be used water-soluble polymers such as polyvinyl alcohol, vinyl acetate, oxidized starch, etherified starch, cellulose derivatives, e.g., carboxymethylcellulose and hydroxyethylcellulose, casein, gelatin, soybean protein, silanol group-modified polyvinyl alcohol; conjugated diene copolymer latexes such as maleic anhydride resin, styrene-butadiene copolymer and methyl methacrylate-butadiene copolymer; acrylic polymer latexes such as polymers or copolymers of acrylate esters and meth-acrylate esters and polymers or copolymers of acrylic acid and methacrylic acid; vinyl polymer latexes such as ethylene-vinyl acetate copolymer; functional group-modified polymer latexes obtained by modifying the above-mentioned various polymers with monomers containing functional group such as carboxyl group; aqueous adhesives such as thermo-setting synthetic resins, e.g., melamine resin and urea resin; synthetic resin adhesives such as polymethyl methacrylate, polyurethane resin, unsaturated polyester resin, vinyl chloride-vinyl acetate copolymer, polyvinyl butyral and alkyd resin. Films are formed using them alone or in combination of two or more.

In the case of using emulsions or latexes as the film-forming materials for the barrier layer, when the barrier layer is coated after the ink-receiving layer has been coated, the remaining plasticizer, surface active agent or the like might migrate into the ink-receiving layer. Accordingly, the water-soluble polymers are especially preferred because they usually do not contain such components.

The object of the present invention can be further surely attained when the barrier layer is provided by extrusion molding or injection molding a thermoplastic resin such as polyethylene, polystyrene, polyvinyl chloride or polyamide.

The barrier layer may be provided using thermosetting resins such as urea resin, melamine resin, phenolic resin, epoxy resin, unsaturated polyester resin, alkyd resin, urethane resin and ebonite, or by means of photocuring such as ultraviolet curing or electron ray curing by photopolymerization of photo-polymerizable prepolymers such as acrylates or methacrylates, e.g., polyester acrylate, epoxy acrylate and polyesterurethane acrylate using photopolymerization initiators such as acetophenone, benzophenone, Michler's ketone, benzyl, benzoin, benzyldimethylketal and thioxanthone.

Thickness of the barrier layer must be varied in order to obtain smooth surface after coating and may vary depending on kind of coating means by which the layer composition is applied, but is preferably in the range of 0.5–20 μm. If the thickness is less than 0.5 μm, partial voids or pinholes of the layer are unavoidable. Even when the thickness is increased to exceed 20 μm, the effect on attaining the object of the present invention does not increase and thus, the thickness exceeding 20 μm is uneconomical.

Supports used in the present invention include base papers prepared by mixing wood fibers, for example, chemical pulp such as LBKP and NBKP, mechanical pulp such as GP, PGW, RPM, TMP, CTMP, CMP and CGP or recycled fibers such as DIP as main component with at least one of known additives such as pigment, binder, sizing agent, fixing agent, retention aid, cationizing agent and strengthening agent and making paper from the resulting mixture by a paper former such as Foudrinier machine, cylinder machine and twin wire machine. The support may be a coated paper such as art paper and cast coated paper. For improving surface smoothness, these supports may be processed prior to being applied with the ink-receiving layer by a machine calender, TG calender, soft calender and the like.

The ink-receiving layer comprises a coating composition mainly composed of pigment and binder. The ink-receiving layer composition may further and optionally contain, as additives, dye fixing agent, pigment dispersing agent, thickening agent, fluidity improver, defoamer, foam inhibitor, releasing agent, foaming agent, penetrant, dye, color pigment, fluorescent brightener, ultraviolet absorber, antioxidant, preservative, slimecide, water proofing agent, wet strengthening agent and dry strengthening agent. If necessary, a backcoat layer may be provided on the side of the support opposite to the side on which the ink-receiving layer is provided.

In order to inhibit the spread of ink dots of a printed sheet when it is exposed to a high humidity atmosphere, it is preferred that at least the surface of the ink-receiving layer has a fixing capability to capture the dye component in the ink by applying a coating composition containing cationic colloid particles. Beneath this fixing layer, an ink-absorbing layer which absorbs the vehicle of the ink may be provided, or alternatively, the support itself may be utilized as the ink-absorbing layer without providing such ink-absorbing layer.

The cationic colloid particles mean those which are suspended and dispersed taking on a colloidal state in water, the surface of which being positively charged. Examples are alumina sols such as boehmite and pseudoboehmite, colloidal alumina, cationic aluminum oxide or hydrate thereof, and colloidal silica particles coated with alumina on the surface as disclosed in Japanese Patent Kokoku No. 47-26959.

Since the cationic colloidal particles once coated and dried are firmly bound in the layer and do not move even though they are moistened, spread of dots in a high humidity atmosphere can be effectively prevented.

While the colloidal particles make a binder by themselves, auxiliary binders may be used in the ink-fixing layer depending on the demanded strength of the coated layer. Of the binders mentioned hereinafter, preferred are nonionic or cationic ones or nonionically or cationically modified ones. Amount of the binders is preferably 2–50 parts by weight based on 100 parts of the inorganic particles constituting the ink-fixing layer. If it is less than 2 parts by weight, fold resistance of the layer considerably decreases and if it exceeds 50 parts by weight, ink absorption into the ink-absorbing layer and/or support decreases to cause bleeding of ink or harmfully affect the ink fixing property of the layer.

In order for the ink-fixing layer to develop ink fixing property, coating weight of the colloidal particles should be 0.5 $g/m^2$ or more. Known pigment can be used in combination with the colloid particles. Coating weight influences the feel of the recording sheet. If a feel of coated paper is desired, the coating weight of the layer is increased. When the coating weight has to be reduced for obtaining a feel of non-coated paper or plain paper, or when fixing of a specific amount of the dye component in the ink of a color is required for controlling color quality, a cationic dye fixing agent can additionally be used. However, use of the dye fixing agent may worsen spread of ink dots of a printed sheet when it is exposed to a high humidity atmosphere, so that its amount must be limited within an allowable range to restrain the spread of ink dots.

The ink-fixing layer may further and optionally contain, as additives, dye dispersing agent, pigment dispersing agent, thickening agent, fluidity improver, defoamer, foam inhibitor, releasing agent, foaming agent, penetrant, color dye, color pigment, fluorescent brightener, ultraviolet absorber, antioxidant, preservative, slimecide, water proofing agent, wet strengthening agent and dry strengthening agent.

As mentioned above, an ink-absorbing layer may be provided between the support and the ink-fixing layer. For example, diffusion of ink along fibers of the support, i.e. feathering, which apt to be prevailing when coating weight of the ink-fixing layer is small, can be inhibited by providing an ink-absorbing layer mainly composed of a known pigment and binder.

The support, the ink-receiving layer and the backcoat layer may contain at least one kind of white pigment known in the art. Examples of the white pigment are inorganic white pigment such as precipitated calcium carbonate, ground calcium carbonate, kaolin, talc, calcium sulfate, barium sulfate, titanium dioxide, zinc oxide, zinc sulfide, zinc carbonate, satin white, aluminum silicate, diatomaceous earth, calcium silicate, magnesium silicate, synthetic amorphous silica, colloidal silica, colloidal alumina, pseudo boehmite, aluminum hydroxide, alumina, lithopone, zeolite, hydrated halloycite, magnesium carbonate and magnesium hydroxide and organic pigment such as styrene plastics pigment, acrylic plastics pigment, polyethylene, micro-capsules, urea resin and melamine resin.

Binders contained in the support, the ink-receiving layer and the backcoat layer include, for example, polyvinyl alcohol, vinyl acetate, oxidized starch, etherified starch, cellulose derivatives such as carboxymethyl cellulose and carboxyethyl cellulose, casein, gelatin, soybean protein, silanol group-modified polyvinyl alcohol; conjugated diene copolymer latexes such as maleic anhydride resin, styrene-butadiene copolymer and methyl methacrylate-butadiene copolymer; acrylic polymer latexes such as polymers or copolymers of acrylic esters and methacrylic esters and polymers or copolymers of acrylic acid and methacrylic acid; vinyl polymer latexes such as ethylene-vinyl acetate copolymer; functional group-modified polymer latexes obtained by modifying the above-mentioned various polymers with monomers containing functional group such carboxyl group; aqueous adhesives such as thermo-setting synthetic resins, for example, melamine resin and urea resin; synthetic resin adhesives such as polymethyl methacrylate, polyurethane resin, unsaturated polyester resin, vinyl chloride-vinyl acetate copolymer, polyvinyl butyral and alkyd resin. These may be used alone or in combination of two or more.

For applying the ink-receiving layer, the backcoat layer and the barrier layer by coating or impregnation, there may be used a variety of coating means known in the art such as blade coater, roll coater, airknife coater, bar coater, rod blade coater, curtain coater, short-dwell coater and size press in the manner of on- or off-machine. The coated sheet may further be surface-finished using calenders such as machine calender, TG calender, super calender and soft calender. When the barrier layer is formed of thermoplastic resins, laminators or melt-extrusion coaters are generally employed.

The tacky layer is formed generally by coating a tacky adhesive on the surface of the undermentioned release paper which has been coated or impregnated with a releasing agent. The ink jet recording sheet with its ink-receiving layer up is superposed on the tacky layer and pressed to make a quick stick label set. Alternatively, the tacky adhesive layer is applied on the back of the ink jet recording sheet, then laid on the release paper and pressed.

Rubber type or acrylic resin type adhesives can be used as the tacky adhesives. The rubber type adhesives comprise mainly natural rubbers or styrene-butadiene rubbers; in the case of the natural rubber, a rubber is mixed with a rosin type resin, plasticizer and the like and dissolved in a solvent like N-hexane to make a tacky adhesive composition; in the case of the styrene-butadiene rubber, the adhesive composition is generally one to be applied by hot-melt coating. The acrylic resin type adhesives generally take a form of emulsion; the emulsified resins are prepared by polymerizing acrylic monomers such as 2-ethylhexyl acrylate, butyl acrylate, ethyl acrylate, acrylic acid and β-hydroxyethyl acrylate, in water using organic solvents, such as ethyl acetate and toluene—the kind of which may vary depending on polymerization method, and surfactants.

In order to improve properties of the tacky adhesives composition such as heat resistance and solvent resistance, the above-mentioned components may be crosslinked using crosslinking agents such as isocyanate, melamine and metal chelate crosslinking agents. Alternatively, thereto may be added pigment such as silica, kaolin, clay, calcium carbonate, aluminum hydroxide, zinc oxide, titanium oxide, melamine resin particle or starch particle or water soluble polymers, petroleum resins, various paraffin waxes, fatty acids or derivatives thereof, higher alcohols, metallic soaps, silicones, antistatic agents, thickening agents, dispersing agents, preservatives, antioxidants and defoamers. The adhesives composition can be optionally selected depending on the end uses of the ink jet recording sheets.

The tacky layer can be formed by various coating means such as airknife coater, blade coater, bar coater, roll coater, slot nozzle, slot die, rotary screen printer, gravure coater, offset gravure coater, hot-melt wheel and spiral spray coater. The applicators may be optionally selected depending on the kind and coating weight of adhesives and besides, depending on uses, for example, whether or not it is required to be applied patternwise.

As the substrates for the release papers, there may be used woodfree paper, kraft paper, glassine paper, plastic film and the like. A silicone resin is coated thereon as a releasing agent. In the case of paper substrate, release performance can be improved by laminating a thermoplastic resin film on the substrate to make a smooth surface. The release paper obtained by directly coating a silicone resin on the paper substrate is called "direct type" that obtained by laminating a thermoplastic resin film on the paper substrate and then coating the silicone resin is called "polylaminated type", and that obtained by directly coating the silicone resin on a plastic film is called "film type". Requirements for the release paper are that it must not peel off while the ink jet recording sheet set with it is put through a printer and that it must release when the printed sheet is put through an automatic labeller. A release paper should be properly selected to meet the specific end use requirements, and when anti-curling property is further demanded, one having an anti-curl backing layer of a thermoplastic resin provided by lamination or coating may be selected. When the end use condition prohibits use of a silicon resin releasing agent, a non-silicone type releasing agent may be selected.

While the ink jet recording sheet of the present invention is meant dominantly to be set with a release paper for use as a quick stick label, it may favorably be put together with any sheet material so long as a bonding agent used therein blocks performance of ink jet recording. There can be thought of a variety of such sheet material; for instance, magnetic recording sheet, ink jet recording sheet, heat-sensitive recording sheet, thermal transfer recording sheet, pressure-sensitive recording sheet and the like.

The aqueous ink referred to in the present invention is a colored liquid for recording comprising colorant, solvent and other additives.

The colorants include water-soluble dyes such as direct dyes, acid dyes, basic dyes, reactive dyes and food dyes.

The solvents for the aqueous ink include water and a variety of hydrophilic organic solvents, for example, alkyl alcohols of 1 to 4 carbon atoms such as methyl alcohol, ethyl alcohol, n-propyl alcohol, isopropyl alcohol, n-butyl alcohol, sec-butyl alcohol, tert-butyl alcohol and isobutyl alcohol; amides such as dimethyl-formamide and dimethylacetamide; ketones or ketone alcohols such as acetone and diacetone alcohol; ethers such as tetrahydrofuran and dioxane; polyalkylene glycols such as polyethylene glycol and polypropylene glycol; alkylene glycols having 2 to 6 alkylene groups such as ethylene glycol, propylene glycol, butylene glycol, triethylene glycol, 1,2,6-hexanetriol, thiodiglycol, hexylene glycol and diethylene glycol; and lower alkyl ethers of polyhydric alcohols such as glycerin, ethylene glycol methyl ether, diethylene glycol methyl (or ethyl) ether and triethylene glycol monomethyl ether. Of these solvents, preferred are polyhydric alcohols such as diethylene glycol and lower alkyl ethers of polyhydric alcohols such as triethylene glycol monomethyl ether and triethylene glycol monoethyl ether. As other additives, mention may be made of, for example, pH buffers, chelating agents, preservatives, viscosity modifiers, surface tension modifiers, wetting agents, surface active agents and anticorrosive agents.

The ink jet recording sheet of the present invention can be used not only as labels, but also as ordinary ink jet recording sheets and besides, as any recording sheets on which an ink which is liquid at the time of recording is put for recording. These recording sheets used for other than ordinary ink jet recording systems include an image-receiving sheet for heat transfer recording system which comprises heating an ink sheet comprising a thin support such as a resin film, a high-density paper or a synthetic paper coated with a heat-meltable ink mainly composed of a heat-meltable substance and dye or pigment from the back side to melt the ink and transferring the molten ink; a sheet for specific ink jet recording which makes use of droplets of a heated and molten ink or an oleophilic ink solution in which an oil-soluble dye is dissolved; and an image-receiving sheet on which images are transferred from a photosensitive and pressure-sensitive donor sheet coated with microcapsules containing a photopolymerizable monomer and colorless or colored dye or pigment.

These recording systems are common in that the ink is in a liquid state at the time of recording. A liquid ink permeates or diffuses vertically and horizontally through the ink-receiving layer until it loses fluidity and becomes fixed. Ink absorbing ability of the recording sheets in conformity with the respective recording system is required, so that the ink jet recording sheet of the present invention can be utilized successfully in these recording systems and recording system for labels.

The ink jet recording sheets of the present invention can also be used as the recording sheets for electrophotographic recording system which is widely used in copying machines, printers and the like, where a toner is fixed by heating.

The inventors have found that when a tacky layer is provided on the back of an ink jet recording sheet, there occurs deterioration in sharpness and color quality of images due to spread of ink dots. The spread of dot diameter is a phenomenon of the aqueous ink to diffuse horizontally on the surface of the recording sheet without being absorbed vertically into the ink-receiving layer. The reason why such phenomenon occurs when a tacky layer is provided is not entirely clear, but it can be supposed from physical viewpoint that a liquid component contained in the tacky adhesive (e.g. water in the case of aqueous type coating composition and ethyl acetate, toluene or the like in the case of solvent type coating composition) migrates into the ink-receiving layer through the support to alter the structure of the ink-receiving layer; it can also be supposed from chemical viewpoint that plasticizer or surfactant of relatively low molecular weight contained in the adhesive migrates into the ink-receiving layer to block the fixability of the printed ink in the ink-receiving layer.

As mentioned earlier, the ink-receiving layer may consist of ink fixing layer and ink absorbing layer. former is meant to fix the dye component in the ink at the surface assisted by chemical bonding between the dye and cationic colloid particles; the latter to absorb the vehicle of the ink mainly by a physical interaction between the vehicle and micropores in the layer. When only an ink-fixing layer is provided as the ink-receiving layer, the support is to assume the role of absorbing ink vehicle. Both of the chemical and physical function of the layers' components are affected harmfully when said liquid components of the tacky layer migrate into the ink-receiving layer. Particularly, such liquid components are apt to fill micropores in the ink-receiving layer reducing its ink-absorbing capacity, or in certain cases they may bond with the dye fixing agent or may make the layer unnecessarily hydrophilic or hydrophobic. In consequence, spread of ink dots on the ink-receiving becomes more intense or even bleeding of ink may result.

Thus, in the present invention, the barrier layer is provided in the ink jet recording sheet in order to avoid the influence of the tacky adhesive. By providing the barrier layer, ink jet recording sheets which do not degrade in sharpness and color quality of images which are features of ink jet recording sheets even if a tacky layer is provided on the back thereof can be obtained.

DESCRIPTION OF THE PREFERRED EMBODIMENTS

The following Examples and Comparative Examples are set forth for purposes of illustration of the invention and should not be construed as limiting the invention in any manner. All parts and % are by weight unless otherwise notified.

All the 10% polyvinyl alcohol solution referred to in the following Examples and Comparative Examples, unless otherwise described, was one prepared as follows;

To 89 parts of water, 11 parts of polyvinyl alcohol (PVA 117 manufactured by Kuraray Co., Ltd.) was added under agitation and heated to 95° C. until it is dissolved completely. Thereafter, water is added to the solution to adjust its solid concentration to 10%.

EXAMPLE 1

A paper stock containing 25 parts of pigments comprising precipitated calcium carbonate/ground calcium carbonate/talc (30/35/35), 0.10 part of commercially available alkyl ketene dimer, 0.03 part of commercially available cationic acrylamide, 1.0 part of commercially available cationized starch and 0.5 part of aluminum sulfate based on 100 parts of wood fibers comprising 70 parts of LBKP (freeness: 400 ml CSF) and 30 parts of NBKP (freeness: 450 ml CSF) was prepared. Using the thus prepared paper stock, a paper sheet to be used for support having a basis weight of 70 g/m$^2$ was formed by a Fourdrinier machine.

A coating composition for an ink-receiving layer was prepared as follows;

100 parts of a synthetic amorphous silica (Finesil X37B manufactured by Tokuyama Soda Co., Ltd.) was dispersed in 588 parts of water, into which 300 parts of the 10% polyvinyl alcohol solution was added under agitation, then further added 20 parts of a cationic dye fixing agent solution (Sumirez Resin 1001 manufactured by Sumitomo Chemical Co., Ltd.; available in a form of 30% solid composition) and finally 99 parts of water was added. Solid concentration of the coating composition was adjusted to 13%.

This coating composition was coated at a dry coating weight of 5 g/m$^2$ on the surface of the above-prepared support by an air knife coater. A barrier layer was provided on another side of the support (the side opposite to the ink-receiving layer side) by coating the 10% polyvinyl alcohol solution at a dry thickness of 4 μm by an air knife coater, and the thus made preparation was dried and then calendered to make a barrier-coated ink jet recording sheet.

A commercially available silicone resin was coated on a glassine paper at 1.0 g/m$^2$ by a gravure coater to make a release sheet and then, a commercially available aqueous acrylic emulsion type tacky adhesive was coated on the surface of the release sheet at a dry coating weight of 20 g/m$^2$. The barrier-coated ink jet recording sheet and the release sheet were laminated by a press roll so that the barrier layer is laid face to face with the tacky coat of the release sheet to obtain an ink jet recording sheet usable as a quick stick label of Example 1.

EXAMPLE 2

A support was produced and an ink-receiving layer was provided in the same manner as in Example 1. A barrier layer was provided on the side of the support opposite to the ink-receiving layer side by coating a styrene-butadiene latex (0693 manufactured by Japan Synthetic Rubber Co., Ltd.) at a dry thickness of 4 μm by an air knife coater, and the thus made preparation was dried and then calendered to make a barrier-coated ink jet recording sheet. A release sheet was prepared and a tacky layer was provided thereon exactly as in Example 1, on which the barrier-coated ink jet recording sheet was laminated with its barrier layer laid face to face with the tacky layer by a press roll to obtain an ink jet recording sheet usable as a quick stick label of Example 2.

EXAMPLE 3

A support and an ink-receiving layer were produced in the same manner as in Example 1. A starch solution for a barrier layer was prepared by dispersing 10 parts of a starch (MS3800 manufactured by Nippon Shokuhin Kako Co.) in 90 parts of water, then heating to 95° C. for being cooked completely. This starch solution was coated on the side of the support opposite to the ink-receiving layer side at a dry thickness of 4 μm by an air knife coater, and the thus made preparation was dried and then calendered to make a barrier-coated ink jet recording sheet. A release sheet was prepared and a tacky layer was provided thereon exactly as in Example 1, on which the barrier-coated ink jet recording sheet was laminated with its barrier layer laid face to face with the tacky layer to obtain an ink jet recording sheet usable as a quick stick label of Example 3.

EXAMPLE 4

A support was produced and an ink-receiving layer was provided in the same manner as in Example 1. A barrier layer was provided on the side of the support opposite to the ink-receiving layer side by applying a commercially available low density polyethylene by a hot-melt coating at a dry thickness of 4 μm, and the thus made preparation was cooled and then calendered to make a barrier-coated ink jet recording sheet. A release sheet was prepared and a tacky layer was provided thereon exactly as in Example 1, on which the barrier-coated ink jet recording sheet was laminated with its barrier layer laid face to face with the tacky layer to obtain an ink jet recording sheet usable as a quick stick label of Example 4.

EXAMPLE 5

A support was produced in the same manner as in Example 1. A barrier layer was provided on a side of the support by coating the 10% polyvinyl alcohol solution at a dry thickness of 4 μm by an air knife coater and dried. Then, the same ink-receiving layer as in Example 1 was coated on the barrier layer in the same manner as in Example 1 to make a barrier-coated ink jet recording sheet. A release sheet was prepared and a tacky layer was provided thereon exactly as in Example 1, on which the barrier-coated ink jet recording sheet was laminated with its back (uncoated side) laid face to face with the tacky layer to obtain an ink jet recording sheet usable as a quick stick label of Example 5.

EXAMPLE 6

A support was produced in the same manner as in Example 1. A barrier layers was provided on both front and back of the support at a dry thickness of 2 μm respectively by coating the 10% polyvinyl alcohol solution by an air knife coater. Then, the same ink-receiving layer as in Example 1 was coated on one side of the both sides barrier-coated support in the same manner as in Example 1, and the thus made preparation was calendered to make a barrier-coated ink jet recording sheet. A release sheet was prepared and a tacky layer was provided thereon exactly as in Example 1, on which the barrier-coated ink jet recording sheet was laminated with its barrier layer laid face to face with the tacky layer by a press roll to obtain an ink jet recording sheet usable as a quick stick label of Example 6.

EXAMPLE 7

A support was produced in the same manner as in Example 1. A barrier layer was firstly provided on the support by coating a styrene-butadiene latex (0693 manufactured by Japan Synthetic Rubber Co., Ltd.; 48% solid)) at a dry thickness of 4 μm by an air knife coater. Then, the same ink-receiving layer as in Example 1 was provided on the side of the support opposite to the barrier layer side and dried in the same manner as in Example 1, and the thus made preparation was calendered to make a barrier-coated ink jet recording sheet. A release sheet was prepared and a tacky layer was provided thereon exactly as in Example 1, on which the barrier-coated ink jet recording sheet was laminated with its barrier layer laid face to face with the tacky layer by a press roll to obtain an ink jet recording sheet usable as a quick stick label of Example 7.

EXAMPLE 8

A barrier-coated ink jet recording sheet was produced in the same manner as in Example 1. A release sheet was prepared exactly as in Example 1, on the silicon resin coat of which a tacky layer was provided by coating a commercially available solvent type (ethylacetate·toluene) resin at a dry coating weight of 20 g/m$^2$. The tacky layer coated release sheet and the barrier-coated ink jet recording sheet were laminated with its barrier layer laid face to face with the tacky layer by a press roll to obtain an ink jet recording sheet usable as a quick stick label of Example 8.

COMPARATIVE EXAMPLE 1

Example 1 was repeated to obtain a sheet having an ink-receiving layer, which in turn, without providing a barrier layer, was calendered to obtain a barrierless ink jet recording sheet. A release sheet was prepared and a tacky layer was provided thereon exactly as in Example 1, on which the barrierless ink jet recording sheet was laminated with its back laid face to face with the tacky layer by a press roll to obtain an ink jet recording sheet usable as a quick stick label of Comparative Example 1.

COMPARATIVE EXAMPLE 2

Comparative Example 1 was repeated to obtain a barrierless ink jet recording sheet. A release sheet was prepared and a tacky layer was provided thereon exactly as in Example 8, on which the barrierless ink jet recording sheet was laminated with its back laid face to face with the tacky layer by a press roll to obtain an ink jet recording sheet usable as a quick stick label of Comparative Example 2.

COMPARATIVE EXAMPLE 3

A support was produced and ink-receiving layer was provided thereon in the same manner as in Example 1, except that the solid concentration of the coating composition for the layer was 15% and dry coating weight was 10 g/m$^2$. The thus prepared ink jet recording sheet in turn, without providing a barrier layer, was calendered to obtain a barrierless ink jet recording sheet. A release sheet was prepared and a tacky layer was provided thereon exactly as in Example 1, on which the barrierless ink jet recording sheet was laminated with its back laid face to face with the tacky layer by a press roll to obtain an ink jet recording sheet usable as a quick stick label of Comparative Example 3.

Evaluation of the ink jet recording sheets obtained in Examples 1–8 and Comparative Examples 1–3 was conducted and the results are shown in Table 1.

<Intensity of dot spread>

Spread of ink dots caused by providing the tacky layer was evaluated by a ratio of diameter (Do) of dots printed on the ink jet recording sheets in the examples and the comparative examples provided with the tacky layer to dot diameter (Dn) of dots printed on the barrier-coated or barrierless ink jet recording sheets in the examples and the comparative examples sheets prior to being laid on the tacky layer for lamination. When the ratio (Do/Dn) exceeds 1.0, there is spread of ink dots, and when it exceeds 1.2, sharpness and color quality of the image are clearly impaired and practically unacceptable. The diameter of dot was measured as a circle defined by the following formula (1). Measurement of Do and Dn was conducted in the following manner. The sample sheet was allowed to stand in an atmosphere of 20° C. and 65% RH for 24 hours for conditioning and then ink dots were printed thereon with a black ink by an ink jet printer (IO-720 manufactured by Sharp Corporation) in the same atmosphere. The diameter of the dot was measured by an image analyzer.

$$D=\{(4/\pi)\times A\}^{1/2} \quad (1)$$

In the above formula, D is diameter of the dot as a circle (dot diameter), A is area measured by the image analyzer.

The notes in Table 1 have the following meanings.

TABLE 1

| | Barrier layer | Kind of solvent of adhesive | Dot spreading ratio (Do/Dn) |
|---|---|---|---|
| Example 1 | Polyvinyl alcohol | Aqueous system | 1.02 |
| Example 2 | Styrene-butadiene latex | Aqueous system | 1.10 |
| Example 3 | Starch | Aqueous system | 1.07 |
| Example 4 | Thermoplastic resin | Aqueous system | 1.00 |
| Example 5 | Polyvinyl alcohol | Aqueous system | 1.01 |
| Example 6*1 | Polyvinyl alcohol | Aqueous system | 1.04 |
| Example 7*2 | Styrene-butadiene latex | Aqueous system | 1.03 |
| Example 8 | Polyvinyl alcohol | Solvent system | 1.01 |
| Comparative Example 1 | No barrier layer | Aqueous system | 1.42 |
| Comparative Example 2 | No barrier layer | Solvent system | 1.31 |
| Comparative Example 3*3 | No barrier layer | Aqueous system | 1.23 |

*1: Two barrier layers were provided between the ink-receiving layer and the support and between the tacky layer and the support.
*2: The ink-receiving layer was coated after the barrier layer was provided.

*3: Coating amount of the ink-receiving layer was 10 g/m$^2$.

As is clear from the above results, ink jet recording sheets usable as quick stick labels which are less in spread of ink dots can be obtained by providing a barrier layer comprising a film-forming material between the support and the ink-receiving layer and/or between the support and the tacky layer according to the present invention.

COMPARATIVE EXAMPLE 4

A support was produced in the same manner as in Example 1. A coating composition for a ink-fixing layer was prepared as follows;

To 100 parts of an alumina hydrate (Cataloid AS-3; diameter of primary particles: about 10 nm; manufactured by Shokubai Kasei Kogyo Co., Ltd.; available in a form of 10% solid dispersion) as cationic colloid particles, 30 parts of the 10% polyvinyl alcohol solution as a binder was added and mixed. Solid concentration of the coating composition was adjusted to 10%.

This coating composition was coated on a side of the support by an air knife coater at a dry coating weight of 1 g/m$^2$ and dried. The thus made preparation, without being coated with a barrier layer, was calendered to obtain a barrierless ink jet recording sheet.

A commercially available silicone resin was coated on a glassine paper at 1.0 g/m$^2$ by a gravure coater to make a release sheet and then, a commercially available aqueous acrylic emulsion type tacky adhesive was coated on the surface of the release sheet at a dry coating weight of 20 g/m$^2$. The barrierless ink jet recording sheet and the tacky layer coated release sheet were laminated with back (i.e. uncoated side) of the former laid face to face with front (i.e. tacky layer) of the latter by a press roll obtain an ink jet recording sheet usable as a quick stick label of Comparative Example 4.

COMPARATIVE EXAMPLE 5

Comparative Example 4 was repeated to obtain a barrierless ink jet recording sheet except that the dry coating weight was 5 g/m$^2$. Then, the barrierless ink jet recording sheet was laminated in the same manner as in Comparative Example 4 to obtain an ink jet recording sheet usable as a quick stick label of Comparative Example 5.

COMPARATIVE EXAMPLE 6

A support was produced in the same manner as in Example 1. A coating composition for an ink-fixing layer was prepared as follows;

To 100 parts of a spherical cationic colloidal silica (Snowtex AK3; diameter of primary particles: 10–20 nm; manufactured by Nissan Chemical Industries, Ltd.) which is cation-modified with an aluminum oxide and is available in a form of 10% solid dispersion, and which was used as cationic colloid particles, 30 parts of the 10% polyvinyl alcohol solution as a binder and 50 parts of water were added and mixed. Solid concentration of the coating composition was adjusted to 10%.

The resulting coating composition for the ink-fixing layer was coated at a dry coating weight of 3 g/m$^2$ by an air knife coater and dried. The thus made preparation without being coated with a barrier layer, was calendered to obtain a barrierless ink jet recording sheet.

A release sheet was obtained, provided with a tacky layer, and laminated with the barrierless ink jet recording sheet in the same manner as in Comparative Example 4 to obtain an ink jet recording sheet usable as a quick stick label of Comparative Example 6.

COMPARATIVE EXAMPLE 7

A barrierless ink jet recording sheet was obtained in the same manner as in Comparative Example 6, except that the coating composition for the ink-fixing layer was prepared as follows;

To 769 parts of a non-spherical cationic colloidal silica (Snowtex UP-AK1; agglomerate of 10–20 nm width× 50–200 nm length; manufactured by Nissan Chemical Industries, Ltd.) which is cation-modified with an aluminum oxide hydrate and is available as a 20% solid dispersion, and which was used as cationic colloid particles, 300 parts of the 10% polyvinyl alcohol solution and 231 parts of water were added and mixed. Solid concentration of the coating composition was adjusted to 10%.

This coating composition for the ink-fixing layer was coated at a dry coating weight of 2 g/m$^2$ and dried. The thus made prepartion, without being coated with a barrier layer, was calendered to obtain a barrierless ink jet recording sheet. A release sheet was obtained, provided with a tacky layer, and laminated with the barrierless ink jet recording sheet in the same manner as in Comparative Example 4 to obtain an ink jet recording sheet usable as a quick stick label of Comparative Example 7.

COMPARATIVE EXAMPLE 8

A barrierless ink jet recording sheet was obtained in the same manner as in Comparative Example 6, except that the coating composition for the ink-fixing layer was prepared as follows and that the dry coating weight was 3.5 g/m$^2$;

To 500 parts of the same cationic colloid particles as used in Comparative Example 6, 300 parts of the 10% polyvinyl alcohol solution was added and mixed, then 50 parts of a cationic dye fixing agent (Sumirez Resin 1001 manufactured by Sumitomo Chemical Co., Ltd.; available in a form of 30% solid composition) and 167 parts of water were further added, and finally solid concentration of the coating composition was adjusted to 15%.

A release sheet was obtained, provided with a tacky layer, and laminated with the barrierless ink jet recording sheet in the same manner as in Comparative Example 4 to obtain an ink jet recording sheet usable as a quick stick label of Comparative Example 8.

EXAMPLE 9

A support and an ink-fixing layer were produced in the same manner as in Comparative Example 7. A barrier layer was provided on the side of the support opposite to the ink-fixing layer side by coating the 10% polyvinyl alcohol solution at a dry thickness of 4 μm by an air knife coater, and the thus made preparation was dried and then calendered to obtain a barrier-coated ink jet recording sheet. A release sheet was obtained, provided with a tacky layer, and laminated with the barrier-coated ink jet recording sheet in the same manner as in Comparative Example 4 to obtain an ink jet recording sheet usable as a quick stick label of Example 9.

EXAMPLE 10

An ink jet recording sheet of Example 10 usable as a quick stick was obtained in the same manner as in Example 9 except that the dry coating weight of the ink-fixing layer was 5 g/m$^2$.

EXAMPLE 11

A support was produced in the same manner as in Example 1. A coating composition for an ink-receiving layer was prepared as follows;

100 parts (solid content) of a synthetic amorphous silica (Finesil X37B manufactured by Tokuyama Soda Co., Ltd.) was dispersed in 588 parts of water, into which 300 parts of the 10% polyvinyl alcohol solution was added under agitation. Solid concentration of the coating composition was adjusted to 13.2%.

This coating composition for the ink-receiving layer was coated first at a dry coating weight of 10 g/m$^2$ on the surface of the support by an air knife coater. Then, on this ink-absorbing layer was further coated an ink-fixing layer in the same manner as in Example 9. Thereafter, barrier layer was provided on the side of the support opposite to the ink-absorbing and ink-fixing layers side and the thus made preparation was dried and then calendered in the same manner as in Example 9 to obtain a barrier-coated ink jet recording sheet.

A release sheet was obtained, provided with a tacky layer, and laminated with the barrier-coated ink jet recording sheet in the same manner as in Comparative Example 4 to obtain an ink jet recording sheet usable as a quick stick label of Example 11.

COMPARATIVE EXAMPLE 9

A support was produced in the same manner as in Example 1. A coating composition for an ink-fixing layer was prepared as follows;

100 parts of a synthetic amorphous silica (Finesil X37B manufactured by Tokuyama Soda Co., Ltd.) as pigment in place of the cationic colloid particles of Comparative Example 4 was dispersed in 588 parts of water. Then, 300 parts of the 10% polyvinyl alcohol solution was added and mixed and further 66.7 parts of a cationic dye fixing agent (Sumirez Resin 1001 manufactured by Sumitomo Chemical Co., Ltd.; available in a form of a 30% solid composition) and 99 parts of water were added and mixed. The solid concentration of the coating composition was adjusted to 13%.

This coating composition was coated on a side of the support by an air knife coater at a dry coating weight of 5 $g/m^2$ and dried. The thus made preparation, without being coated with a barrier layer, was calendered to obtain a barrierless ink jet recording sheet, which in turn was laminated with a the release sheet in the same matter as in Comparative Example 4 to obtain an ink jet recording sheet usable as a quick stick label of Comparative Example 9.

COMPARATIVE EXAMPLE 10

Comparative Example 9 was repeated, except that anionic colloid particles were employed in place of the synthetic amorphous silica in preparing a coating composition for an ink-fixing layer. Namely, the coating composition was prepared as follows;

250 parts of anionic colloid particles (Snowtex 40; diameter of particles: 15 nm; manufactured by Nissan Chemical Industries, Ltd.) which are available in a form of 30% solid dispersion, 300 parts of the 10% a polyvinyl alcohol, and 100 parts of water are mixed. The solid concentration of the coating composition was adjusted to 20%.

An ink jet recording sheet usable as a quick stick label Comparative Example 10 was obtained.

COMPARATIVE EXAMPLE 11

A commercially available polyethylene terephthalate film having no ink absorbability was used as a support. An ink-fixing layer was provided on the film by coating the same coating composition as used in Comparative Example 4 at a dry coating weight of 2 $g/m^2$ on the surface of the film support by an air knife coater. Then, a tacky layer was provided in the same manner as in Comparative Example 4 to obtain an ink jet recording sheet usable as a quick stick label Comparative Example 11.

Results of evaluation of the ink jet recording sheets obtained in Examples 9–11 and Comparative Examples 4–11 are shown in Table 2.

The characteristics shown in Table 2 were evaluated by the following methods. Printing was conducted using an ink jet printer (BJC820J manufactured by Canon, Inc.).

<Ink absorbability>

An rectangular solid pattern (red) was printed using magenta ink and yellow inks, and adjacent to this pattern an another rectangular solid pattern (green) was printed using cyan and yellow inks. Degree of color mixing at the boundary between the two solid patterns was visually inspected and graded by the following criteria. When the ink absorbability is poor, a black line appears at the boundary due to the mixing of the colors. The grades A and B are practically acceptable.

A: No black line is observed and the ink absorbability is excellent.

B: Black line is partially observed, but this is practically acceptable.

C: Black line is observed throughout the boundary and this is practically unacceptable.

D: Thick black line is observed throughout the boundary and this is practically unacceptable.

<Intensity of dot spread>

Spread of dot diameter caused by bleeding of ink by providing the tacky layer was evaluated by the ratio (Lo: Do/Dn) of dot diameter (Do) obtained using the samples of the examples and the comparative examples and dot diameter (Dn) obtained using the samples which correspond to those of the examples and the comparative examples, but are provided with no tacky layer. The samples were allowed to stand in an atmosphere of 20° C. and 65% RH for 24 hours for conditioning and then ink dots were printed thereon with a black ink by the above-mentioned ink jet printer in the same atmosphere. The diameter of the dot as a circle defined by the following formula (2) was measured by an image analyzer.

Furthermore, spread of dot in a high moist atmosphere was evaluated in the following manner. That is, the samples of the examples and the comparative examples were allowed to stand in an atmosphere of 20° C. and 65% RH and then, the dot diameter (Do) was measured in the same atmosphere. Thereafter, these samples were allowed to stand in an atmosphere of 40° C. and 90% RH for 48 hours for conditioning and then, the dot diameter (Dw) was measured. The evaluation was conducted by the ratio (Lw: Dw/Do). Dw is defined to be a diameter of dot as a circle calculated by the following formula (2).

When the ratios (Lo and Lw) which indicate spread of the dot diameter exceed 1.0, this shows that the dot spreads.

$$Di=\{(4/\pi)\times Ai\}^{1/2} \quad (2)$$

In the above formula, Di is a diameter of the dot as a circle (dot diameter), Ai is an actually measured area and i is a variable which shows the conditions for measuring the diameter.

TABLE 2

| | Ink absorption | Ratio of dot spread Lo | Lw |
|---|---|---|---|
| Comparative Example 4 | A | 1.18 | 1.09 |
| Comparative Example 5 | A | 1.09 | 1.02 |
| Comparative Example 6 | A | 1.14 | 1.04 |
| Comparative Example 7 | A | 1.11 | 1.05 |
| Comparative Example 8 | A | 1.17 | 1.10 |
| Example 9 | A | 1.01 | 1.05 |
| Example 10 | A | 1.00 | 1.02 |
| Example 11 | A | 1.00 | 1.01 |

TABLE 2-continued

| | Ink absorption | Ratio of dot spread Lo | Lw |
|---|---|---|---|
| Comparative Example 9 | A | 1.40 | 1.30 |
| Comparative Example 10 | D | 1.42 | 1.32 |
| Comparative Example 11 | C | 1.00 | 1.06 |

As shown in Table 2, in Comparative Example 9 where an ink-fixing layer was provided using porous inorganic pigment, ink absorbability was good, but spread of dot after having undergone a high humidity environment was intense. In Comparative Example 10 where an ink-fixing layer was provided using anionic colloid particles, diffusion of ink was amplified too much rendering rugged contour of dots (i.e. feathering), spread of ink dots was intense, and sharpness of image was inferior. In Comparative Example 11 where a polyethylene terephthalate film having no ink absorbability was used as a support, spread of dot diameter was small, but ink absorbability was poor.

In Examples 9 through 11, where a barrier layer was provided between the fibrous support and the tacky layer and an ink-receiving (or ink-fixing) layer was provided using cationic colloid particles, ink absorption is good and ratio of dot spread before and after the accelerated humidity test was small, and thus the ink-jet recording sheet was excellent.

What is claimed is:

1. An ink jet recording sheet which comprises a support comprising wood fibers, an ink-receiving layer provided on one side of the support and a tacky layer provided on the other side of the support wherein a barrier layer comprising a film-forming material is provided between the support and the ink-receiving layer.

2. An ink jet recording sheet according to claim 1, wherein the ink-receiving layer comprises a synthetic amorphous silica.

3. An ink jet recording sheet according to claim 1, wherein the film-forming material is a water-soluble polymer.

4. An ink jet recording sheet according to claim 1, wherein the film-forming material is a thermoplastic resin.

5. An ink jet recording sheet according to claim 1, wherein the barrier layer is provided by coating a latex.

6. An ink jet recording sheet according to claim 1, wherein a release paper is provided on the tacky layer.

7. An ink jet recording sheet according to claim 1, wherein a barrier layer comprising a film-forming material is further provided between the support and the tacky layer.

8. A method for producing an ink jet recording sheet which comprises providing a barrier layer comprising a film-forming material on one side of a support comprising wood fibers, providing an ink-receiving layer by coating a composition containing at least one of a synthetic amorphous silica and cationic colloid particles on said barrier layer, and providing a tacky layer on the other side of the support, wherein the barrier layer is provided between the support and the ink receiving layer.

* * * * *